US010727633B2

(12) United States Patent
Purdy et al.

(10) Patent No.: US 10,727,633 B2
(45) **Date of Patent: *Jul. 28, 2020**

(54) APPARATUSES FOR MAINTAINING ELECTRICAL GROUNDING AT THREADED INTERFACE PORTS

(71) Applicant: PPC BROADBAND, INC., East Syracuse, NY (US)

(72) Inventors: Eric J. Purdy, Constantia, NY (US); Noah P. Montena, Syracuse, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/271,400

(22) Filed: Feb. 8, 2019

(65) Prior Publication Data

US 2019/0173242 A1 Jun. 6, 2019

Related U.S. Application Data

(63) Continuation of application No. 15/470,521, filed on Mar. 27, 2017, now Pat. No. 10,205,288.
(Continued)

(51) Int. Cl.
*H01R 24/40* (2011.01)
*H01R 9/05* (2006.01)
(Continued)

(52) U.S. Cl.
CPC ..... *H01R 24/40* (2013.01); *H01R 9/05* (2013.01); *H01R 13/622* (2013.01); *H01R 2103/00* (2013.01)

(58) Field of Classification Search
CPC .. H01R 13/622; H01R 2103/00; H01R 24/40; H01R 13/111; H01R 13/639;
(Continued)

(56) References Cited

U.S. PATENT DOCUMENTS 2,913,031 A 11/1959 McKay et al.
3,437,119 A 4/1969 Dey
(Continued)

OTHER PUBLICATIONS

Jun. 21, 2017 International Search Report issued in International Patent Application No. PCT/US17/24344.
(Continued)

*Primary Examiner* — Edwin A. Leon
*Assistant Examiner* — Matthew T Dzierzynski
(74) *Attorney, Agent, or Firm* — MH2 Technology Law Group, LLP

(57) ABSTRACT

An electrical continuity apparatus for a coaxial cable interface port including an interface port, a cable connector, and a resilient member. The interface port includes a first end having a threaded outer surface, and the cable connector includes a coupler having a threaded inner surface. The coupler is configured to rotatably couple the threaded inner surface with the threaded outer surface of the first end of the interface port. The resilient member is arranged between the interface port and the cable connector and urges threads of the threaded inner surface of the coupler into engagement with threads of the threaded outer surface of the interface port to provide electrical continuity between the coupler and the threaded outer surface of interface port even when coupler is loosely tightened to the interface port.

45 Claims, 14 Drawing Sheets

Related U.S. Application Data

(60) Provisional application No. 62/313,504, filed on Mar. 25, 2016.

(51) Int. Cl.
*H01R 13/622* (2006.01)
*H01R 103/00* (2006.01)

(58) Field of Classification Search
CPC .. H01R 13/6474; H01R 13/746; H01R 24/44; H01R 24/525; H01R 33/975; H01R 9/05
See application file for complete search history.

(56) References Cited

U.S. PATENT DOCUMENTS

| | | | |
|---|---|---|---|
| 4,204,566 | A | 5/1980 | Kirrish et al. |
| 4,478,474 | A | 10/1984 | Gallusser et al. |
| 6,318,939 | B1 | 11/2001 | Avaux |
| 7,887,354 | B2 | 2/2011 | Holliday |
| 8,152,551 | B2 | 4/2012 | Zraik |
| 8,961,222 | B2 | 2/2015 | Wang et al. |
| 8,992,148 | B2 | 3/2015 | Schafer et al. |
| 9,166,324 | B2 | 10/2015 | Wang et al. |
| 9,246,275 | B2 | 1/2016 | Holland et al. |
| 2012/0196464 | A1 | 8/2012 | Lu |

OTHER PUBLICATIONS

Oct. 20, 2017 Office Action Issued in U.S. Appl. No. 15/470,521.
Oct. 9, 2019 Search Report issued in European Application No. 17771317.9.

APPARATUSES FOR MAINTAINING ELECTRICAL GROUNDING AT THREADED INTERFACE PORTS

CROSS-REFERENCE TO RELATED APPLICATION

This application is a Continuation of U.S. application Ser. No. 15/470,521 filed Mar. 27, 2017, which claims the benefit of U.S. Provisional Application No. 62/313,504, filed Mar. 25, 2016. The disclosures of the prior applications are hereby incorporated by reference herein in their entireties.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference.

Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port.

However, often connectors are not fully and/or properly tightened or otherwise installed to the interface port and proper electrical mating of the connector with the interface port does not occur. Moreover, typical component elements and structures of common connectors may permit loss of ground and discontinuity of the electromagnetic shielding that is intended to be extended from the cable, through the connector, and to the corresponding coaxial cable interface port. In particular, in order to allow the threaded nut of a connector to rotate relative to the threaded interface port, sufficient clearance must exist between the matching male and female threads. As shown in FIG. 16, when the connector is left loose on the interface port (i.e., not fully and/or properly tightened), gaps 99 may still exist between surfaces of the mating male and female threads, thus creating a break in the electrical connection of ground.

Accordingly, there is a need to overcome, or otherwise lessen the effects of, the disadvantages and shortcomings described above. Hence a need exists for an improved apparatus having structural component elements included for improving ground continuity between the coaxial cable, the connector and its various applicable structures, and the coaxial cable connector interface port.

SUMMARY

According to various aspects of the disclosure, an electrical continuity apparatus for a coaxial cable interface port includes an interface port, a cable connector, and a resilient member. The interface port includes a first end having a threaded outer surface, and the cable connector includes a coupler having a threaded inner surface. The coupler is configured to rotatably couple the threaded inner surface with the threaded outer surface of the first end of the interface port. The resilient member is arranged between the interface port and the cable connector and urges threads of the threaded inner surface of the coupler into engagement with threads of the threaded outer surface of the interface port to provide electrical continuity between the coupler and the threaded outer surface of interface port even when coupler is loosely tightened to the interface port.

According to some embodiments, the resilient member of the electrical continuity apparatus is configured to urge the coupler in an axial direction relative to a longitudinal axis of the interface port.

In some aspects, the interface port includes a second end spaced apart from the first end along a longitudinal axis of the interface port and a flange between the first end and the second end that defines a shoulder facing the first end. The resilient member may be arranged between the shoulder of the interface port and the coupler, the resilient member being configured to urge the coupler away from the shoulder in an axial direction relative to the longitudinal axis of the interface port, thereby urging threads of the threaded inner surface of the coupler into engagement with threads of the threaded outer surface of the interface port to provide electrical continuity between the coupler and the threaded outer surface of interface port.

According to various aspects, the resilient member may comprise a coil spring extending about the threaded outer surface of the first end of the interface port.

According to some aspects, as the coupler is rotated relative to the first end of the interface port in a tightening direction, a forward end face of the coupler compresses the resilient member against a rearward-facing surface of the shoulder and the resilient member reactively urges the coupler away from the shoulder such that rearward-facing surfaces of the threaded inner surface of the coupler contact forward-facing surfaces of the threaded outer surface of the first end of the interface port.

In other embodiments, the resilient member is configured to urge the coupler in a transverse direction relative to a longitudinal axis of the interface port.

According to some aspects, the resilient member of the electrical continuity apparatus is arranged between the interface port and the cable connector in a radial direction relative to a longitudinal axis of the interface port. The resilient member may be configured to (i) urge the coupler and the first end of the interface port away from one another at a first location about a circumference of the interface port, and (ii) urge the coupler and the first end of the interface port toward one another at a second location about the circumference of the interface port that is diametrically opposed to the first location, thereby urging threads of the threaded inner surface of the coupler into engagement with threads of the threaded outer surface of the interface port to provide electrical continuity between the coupler and the threaded outer surface of interface port.

In various aspects, the threaded outer surface of the first end of the interface port includes a groove extending in the axial direction, the groove being configured to receive the resilient member.

According to some aspects, the threaded inner surface of the coupler includes a groove extending in the axial direction, the groove being configured to receive the resilient member.

In accordance with various aspects of the disclosure, an electrical continuity apparatus for a coaxial cable interface port includes an interface port, a cable connector, and a resilient member. The interface port has a first end and a second end spaced apart along a longitudinal axis, and a flange between the first end and the second end that defines a shoulder facing the first end. The first end has a threaded outer surface. The cable connector includes a coupler having a threaded inner surface. The coupler is configured to rotatably couple the threaded inner surface with the threaded outer surface of the first end of the interface port. The resilient member is arranged between the shoulder of the interface port and the coupler and is configured to urge the coupler away from the shoulder in an axial direction relative to the longitudinal axis of the interface port, thereby urging threads of the threaded inner surface of the coupler into engagement with threads of the threaded outer surface of the interface port to provide electrical continuity between the coupler and the threaded outer surface of interface port.

In some aspects, the resilient member of the electrical continuity apparatus is configured to provide electrical continuity between the coupler and the threaded outer surface of interface port even when the coupler is loosely tightened to the interface port.

According to various aspects, the resilient member comprises a coil spring extending about the threaded outer surface of the first end of the interface port.

According to some aspects, as the coupler is rotated relative to the first end of the interface port in a tightening direction, a forward end face of the coupler compresses the resilient member against a rearward-facing surface of the shoulder and the resilient member reactively urges the coupler away from the shoulder such that rearward-facing surfaces of the threaded inner surface of the coupler contact forward-facing surfaces of the threaded outer surface of the first end of the interface port.

According to various aspects of the disclosure, an electrical continuity apparatus for a coaxial cable interface port includes an interface port, a cable connector, and a resilient member. The interface port has a first end along a longitudinal axis, and the first end has a threaded outer surface. The cable connector includes a coupler having a threaded inner surface. The coupler is configured to rotatably couple the threaded inner surface with the threaded outer surface of the female end of the interface port. The resilient member is arranged between the interface port and the cable connector in a radial direction relative to the longitudinal axis of the interface port. The resilient member is configured to (i) urge the coupler and the first end of the interface port away from one another at a first location about a circumference of the interface port, and (ii) urge the coupler and the first end of the interface port toward one another at a second location about the circumference of the interface port that is diametrically opposed to the first location, thereby urging threads of the threaded inner surface of the coupler into engagement with threads of the threaded outer surface of the interface port to provide electrical continuity between the coupler and the threaded outer surface of interface port.

In some aspects, the resilient member of the electrical continuity apparatus is configured to provide electrical continuity between the coupler and the threaded outer surface of interface port even when the coupler is loosely tightened to the interface port.

According to various aspects, the threaded outer surface of the first end of the interface port includes a groove extending in the axial direction, the groove being configured to receive the resilient member.

According to some aspects, the threaded inner surface of the coupler includes a groove extending in the axial direction, the groove being configured to receive the resilient member.

In accordance with any of the aforementioned various aspects, the interface port is a barrel connector, and the first end is a female end.

BRIEF DESCRIPTION OF THE DRAWINGS

Features and advantages of the present disclosure are described in, and will be apparent from, the following Brief Description of the Drawings and Detailed Description.

DETAILED DESCRIPTION

Figure 1:
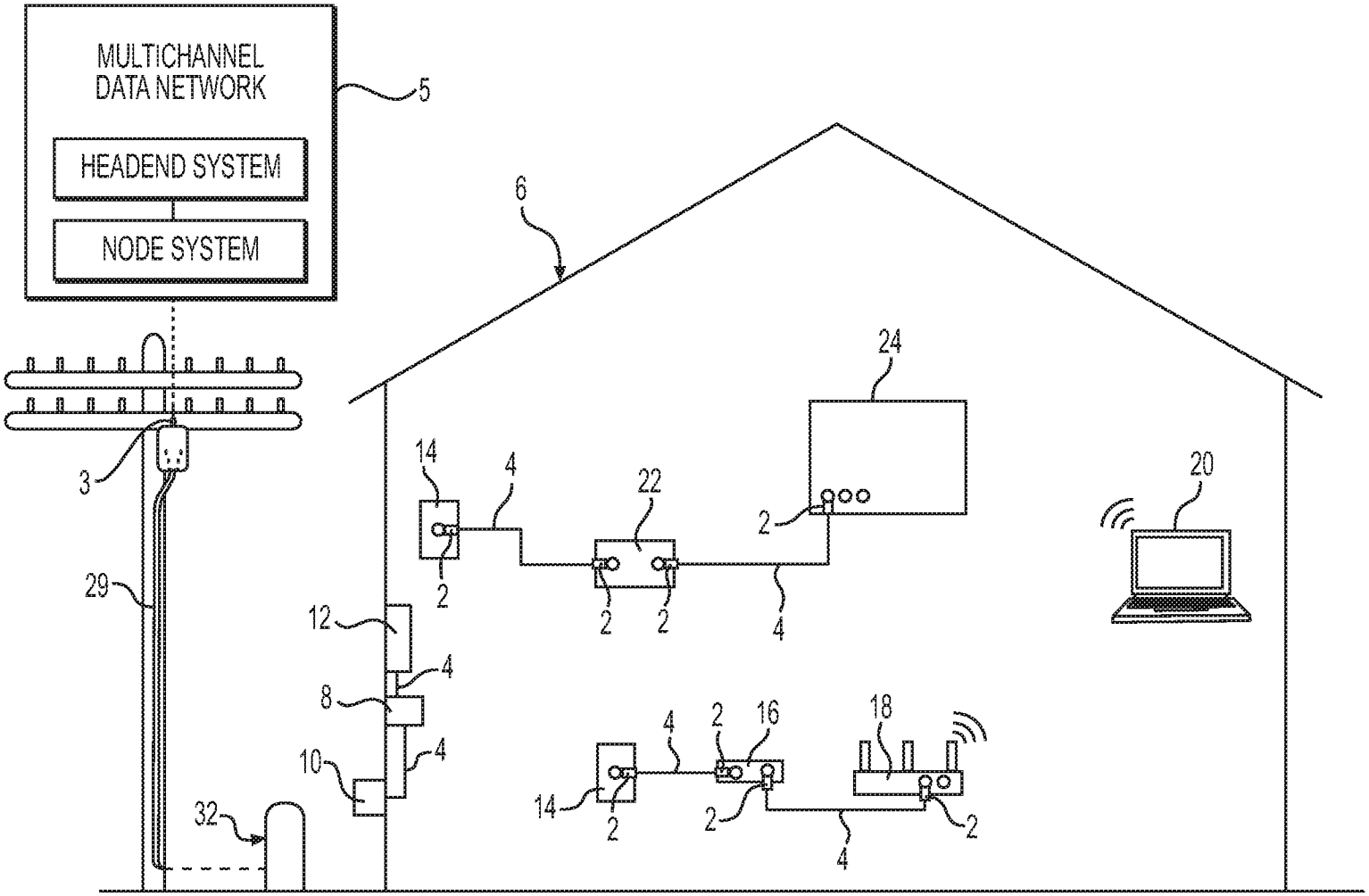
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24.

In one embodiment, the set-top unit 22, typically supplied by the data provider (e.g., the cable TV company), includes a TV tuner and a digital adapter for High Definition TV.

In some embodiments, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol ("VoIP") phone service, Internet Protocol TV ("IPTV") data streams, multimedia content, audio data, music, radio and other types of data.

In some embodiments, the multichannel data network 5 is operatively coupled to a multimedia home entertainment network serving the environment 6. In one example, such multimedia home entertainment network is the Multimedia over Coax Alliance ("MoCA") network. The MoCA network increases the freedom of access to the data network 5 at various rooms and locations within the environment 6. The MoCA network, in one embodiment, operates on cables 4 within the environment 6 at frequencies in the range of 1125 MHz to 1675 MHz. MoCA compatible devices can form a private network inside the environment 6.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
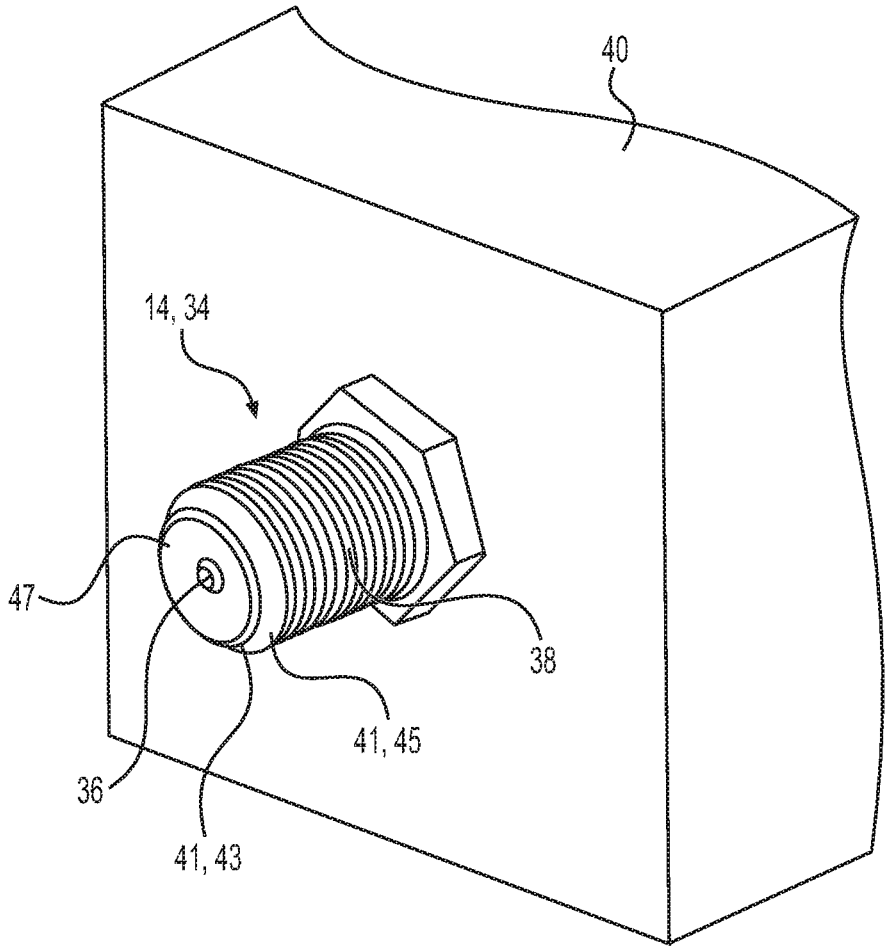
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 4:
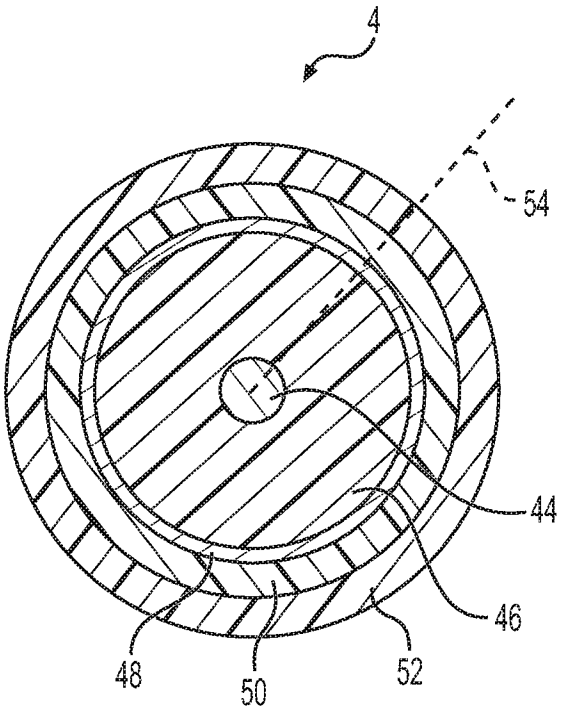
FIG. 4 is a cross-sectional view of the exemplary coaxial cable of FIG. 3.
Figure 3:
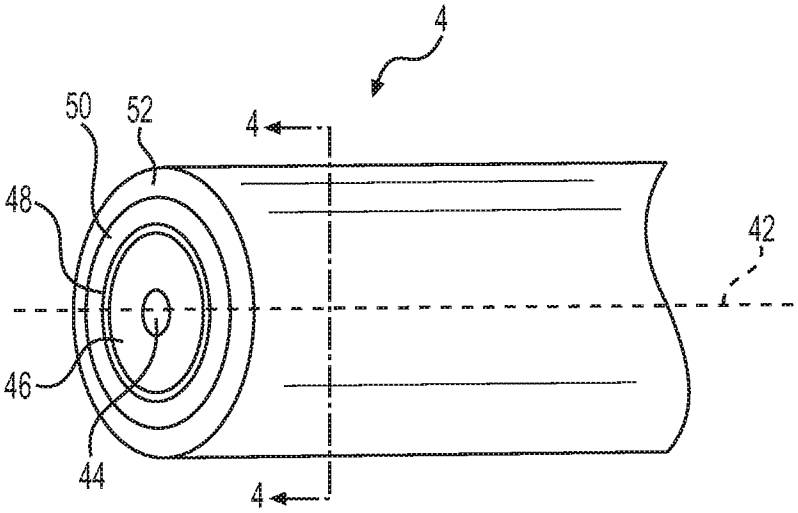
FIG. 3 is a perspective view of an exemplary coaxial cable in accordance with various aspects of the disclosure.
Figure 5:
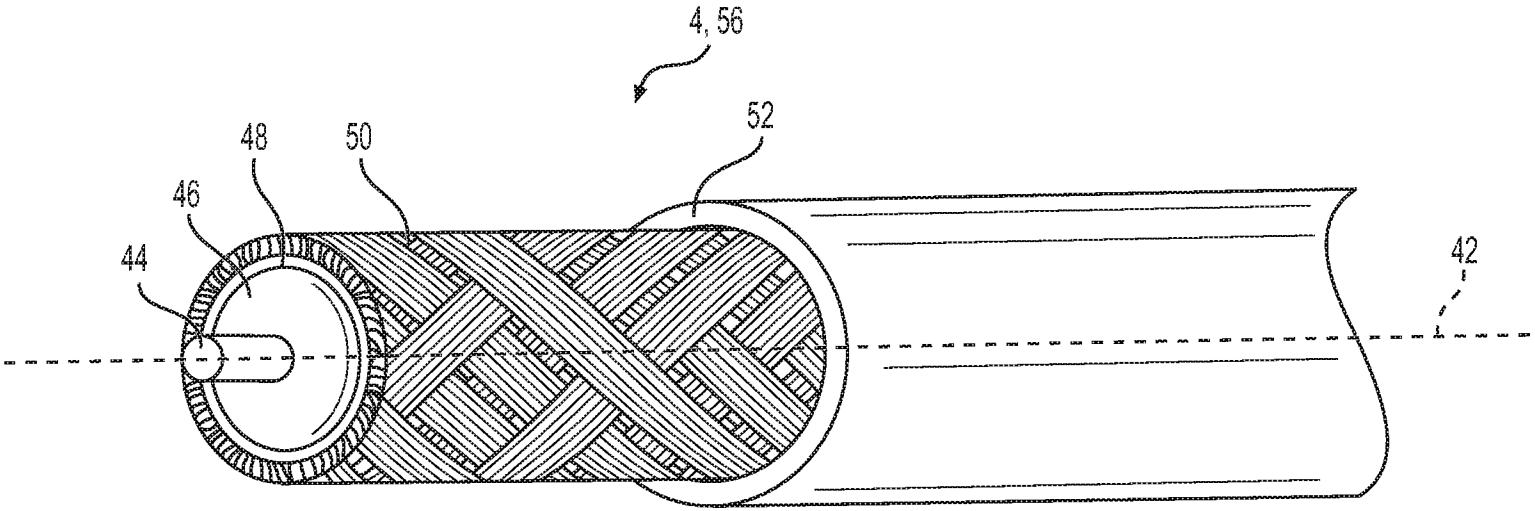
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment an installer or preparer prepares a terminal end 56 of the cable 4 so that it can be mechanically connected to the connector 2. To do so, the preparer removes or strips away differently sized portions of the jacket 52, outer conductor 50, foil 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared end has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 6:
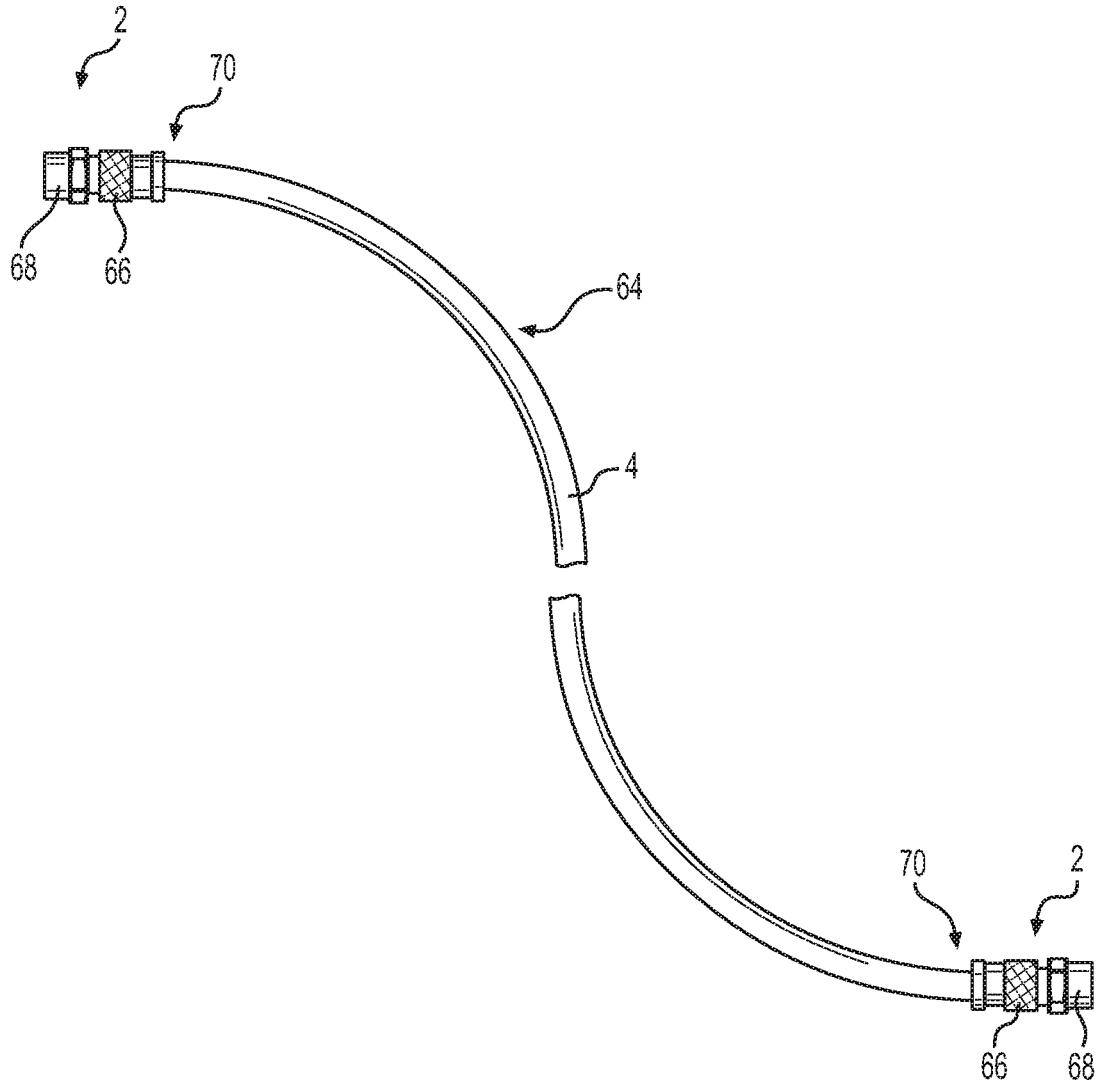
FIG. 6 is a top view of one embodiment of a coaxial cable jumper or cable assembly which is configured to be operatively coupled to the multichannel data network.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

The cable connector of the present disclosure provides a reliable electrical ground, a secure axial connection and a watertight seal across leakage-prone interfaces of the coaxial cable connector.

The cable connector comprises an outer conductor engager or post, a housing or body, and a coupler or threaded nut to engage an interface port. The outer conductor engager includes an aperture for receiving the outer braided conductor of a prepared coaxial cable, i.e., an end which has been stripped of its outer jacket similar to that shown in FIG. 5, and a plurality of resilient fingers projecting axially away from the interface port. The body receives and engages the resilient fingers of the outer conductor engage to align the body with the outer conductor engager in a pre-installed state.

During installation, the body is bearing-mounted to the coupler and translates axially relative to the outer conductor engager as the coupler engages the interface port. The body is configured such that axial translation effects radial displacement of the resilient fingers against an outer peripheral surface of the braided conductor. In an installed state, the resilient fingers effect a reliable electrical ground from the outer conductor to the interface port through the outer conductor engager. Furthermore, the resilient fingers effect a secure mechanical connection between the coaxial cable and the connector as a barbed edge of each resilient finger retards the axial motion of the coaxial cable relative to the outer conductor engager. Finally, a watertight seal is produced at the mating interfaces between the outer conductor engager, the body, and the coupler. More specifically, the body and the coupler produce watertight seals with the outer conductor engager as each moves from a partially-installed state to a fully-installed state.

According to the disclosure, the aforementioned connectors 2 may be configured as coaxial cable connectors 110, 310, and the interface port 14 may be configured as barrel connectors 150, 250, as illustrated in FIGS. 7-15. For the purposes of establishing a directional frame of reference, the forward and rearward directions relative to the connector 110, 310 and the barrel connector 150, 250 are given by arrows F and R, respectively. When the connector 110, 310 is installed on the barrel connector 150, 250, a forward end, portion, or direction is proximal to, or toward, the barrel connector 150, 250 and a rearward end, portion, or direction is distal, or away, from the barrel connector 150, 250.

For purposes of this disclosure, with reference to the cable connectors 110, 310 and the barrel connector 150, 250, a loosely assembled state or configuration refers to the cable connector 110, 310 being coupled with the barrel connector 150, 250 but not fully tightened. A fully assembled state or configuration refers to the cable connector 110, 310 being fully tightened to the barrel connector 150, 350, that is, for example, when there is no space between an outer conductor engager (or post) of the cable connector 110, 310 and the face of the interface port (i.e., the face of the barrel connector 150, 250).

According to various aspects of the disclosure, the coaxial cable connector 110, 310 includes a threaded coupler or nut 116 rotatably coupled with a body or housing 114. The threaded coupler 116 includes a threaded inner surface 126 having threads defined by forward-facing surfaces 113 and rearward-facing surfaces 115 angled relative to one another and connecting to one another at valleys 117. In some aspects, the cable connector 110, 310 may include an outer conductor engager or post 112 and a continuity member 118 that facilitates extension of electrical ground continuity through the outer conductor engager 112 and, in some aspects, through the coupler 116.

In accordance with various aspects of the disclosure, the barrel connector 150, 250 includes two female ends 152, 154, at opposite ends of the barrel connector 150, 250 in an axial direction X, to which coaxial cable connectors 110, 310 may be operatively connected. A mid-section of the barrel connector 150, 250 includes a hex head 156 that facilitates connection of the cable connectors 110, 310 to the barrel connector 150, 250. For example, the hex head 156 may facilitate mounting of the barrel connector 150, 250 to a wall plate or a bracket, or the hex head 156 may be gripped by a wrench while the cable connectors 110, 310 are tightened to the barrel connector 150, 350.

The outer surface 162, 164 of each of the respective female ends 152, 154 is threaded so as to receive the threaded coupler 116 thereon. Each outer surface 162, 164 includes threads defined by forward-facing surfaces 163 and rearward-facing surface 165 angled relative to one another and connecting to one another at valleys 167. The threaded coupler 116 can be tightened to the barrel connector 150 by relative rotation from a loosely tightened state to a fully tightened state. The female ends 152, 154 may be shaped and sized to be compatible with the F-type coaxial connection standard.

Figure 7:
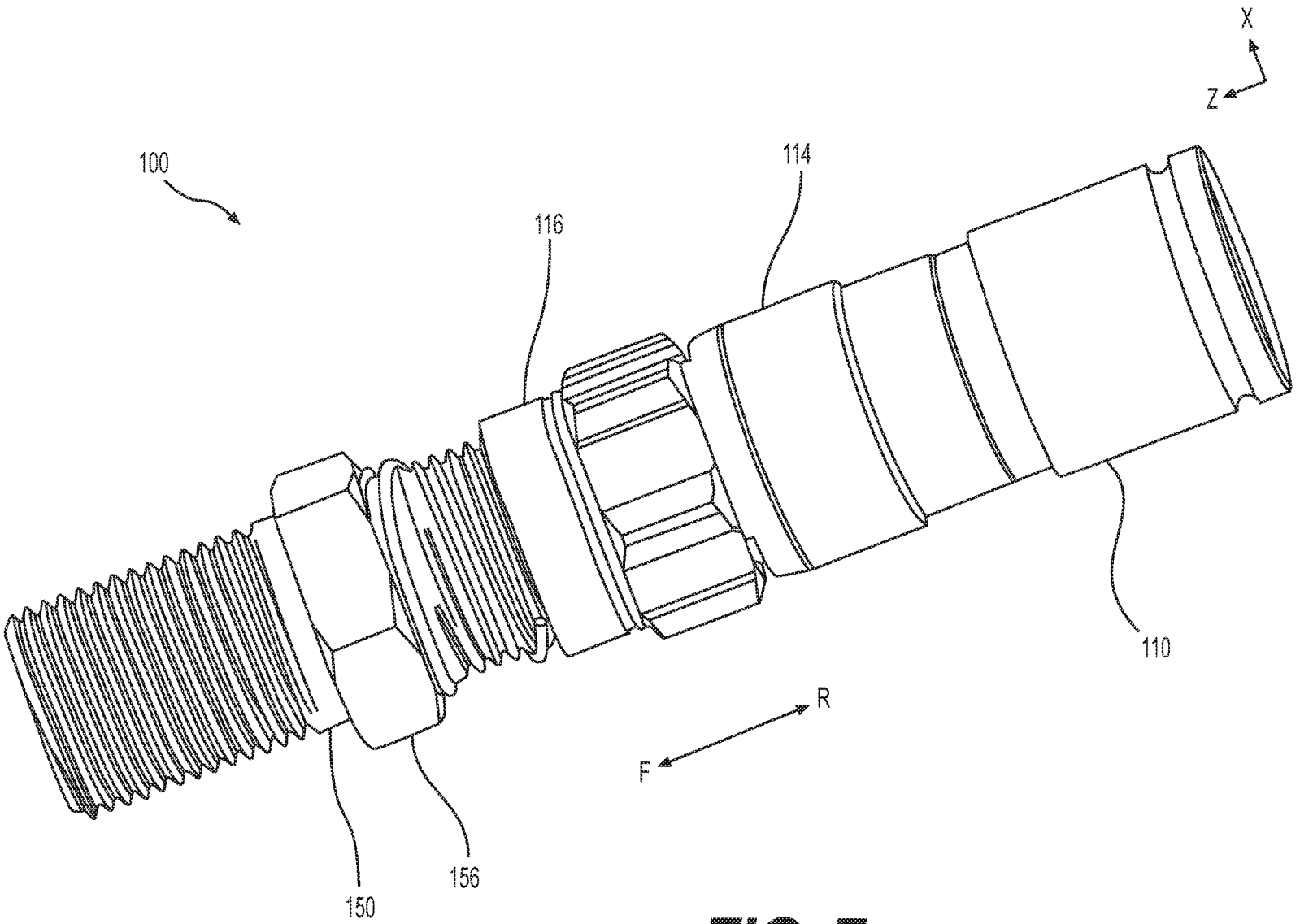
FIG. 7 is a perspective view of an exemplary apparatus for improving electrical continuity between a cable connector and a barrel connector.
Figure 8:
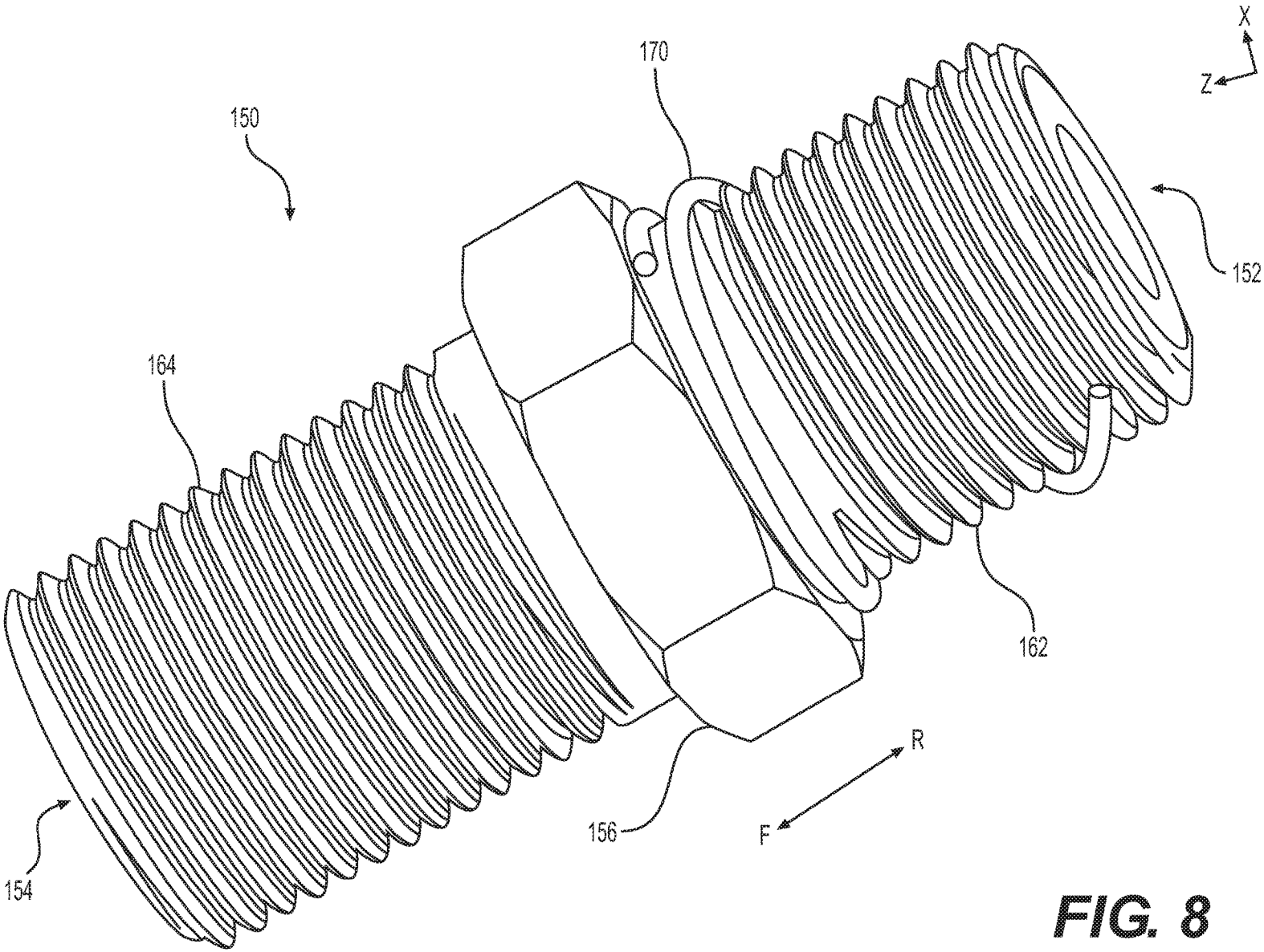
FIG. 8 is a perspective view of a portion of the apparatus of FIG. 7.
Figure 9:
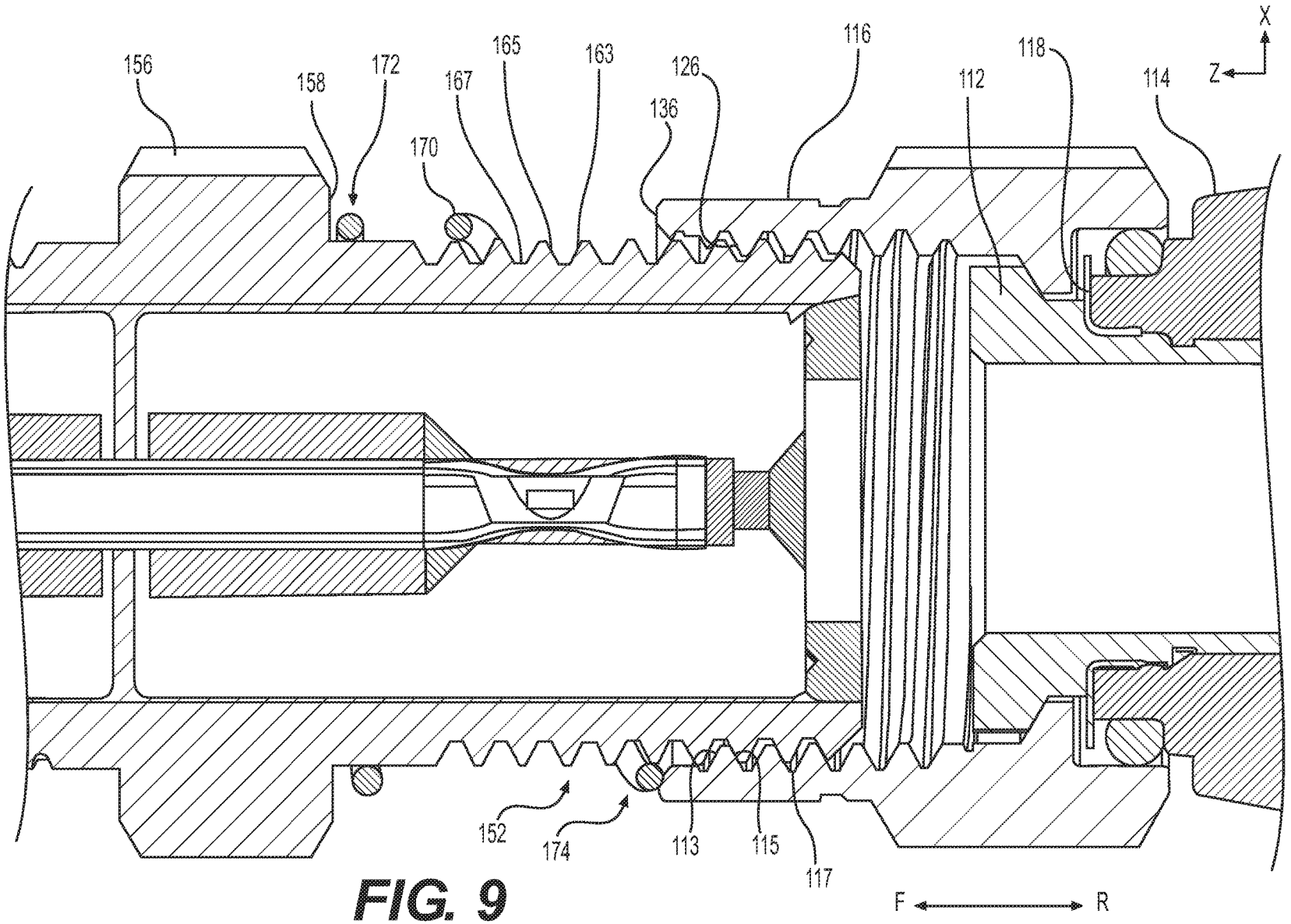
FIG. 9 is a side cross-sectional view of the apparatus of FIG. 7.

Referring to FIGS. 7-9, an embodiment of an apparatus 100 for improving electrical continuity between the cable connector 110 and the barrel connector 150 is disclosed. Particularly, the apparatus 100 is configured to improve electrical continuity between the threaded coupler 116 of the cable connector 110 and one of the ends 152, 154 of the barrel connector 150 (female end 152 illustrated in FIG. 9). The apparatus 100 includes the cable connector 110, the barrel connector 150, and a resilient member 170, such as a coil spring.

As shown in FIGS. 7-9, the resilient member 170 is disposed about the outer circumference of the female end 152. A first end 172 of the resilient member 170 is proximate to and may abut a first shoulder 158 defined by the hex head 156 and facing the female end 152. The resilient member 170 includes a second end 174 spaced from the hex head 156 when the resilient member 170 is in an uncompressed configuration (FIG. 8). As would be understood by persons skilled in the art, as the resilient member 170 is compressed in the axial direction, the second end 174 is disposed more proximate to the first end 172.

Referring now to FIG. 9, when the threaded coupler 116 is coupled with the threaded outer surface 162 of the female end 152, relative rotation of the coupler 116 relative to the female end 152, for example, in a clockwise direction, brings a forward end face 136 of the threaded coupler 116 into contact with the second end 174 of the resilient member. Continued relative rotation of the coupler 116 relative to the female end 152 compresses the second end 174 of the resilient member 170 toward the hex head 156. Meanwhile, the resilient member 170 provides a reactive force in the axial direction against the forward end face 136 of the threaded coupler 116, which urges the threaded coupler 116 away from the hex head 156 in the axial direction. The threads of the threaded coupler 116 and the threaded outer surface 162 limit the movement of the threaded coupler 116 in the axial direction. That is, the threaded coupler 116 can only move in the axial direction until one or more of the forward facing surfaces 163 of the threaded outer surface 162 of the female end 152 contact one or more corresponding rearward facing surfaces 115 of the threaded coupler 116. As a result of the reaction force of the compressed resilient member 170, electrical continuity between cable connector 110 and the barrel connector 150 is maintained even when the threaded coupler 116 is loosely tightened (i.e., partially tightened, but not fully tightened) to the barrel connector 150.

Figure 10:
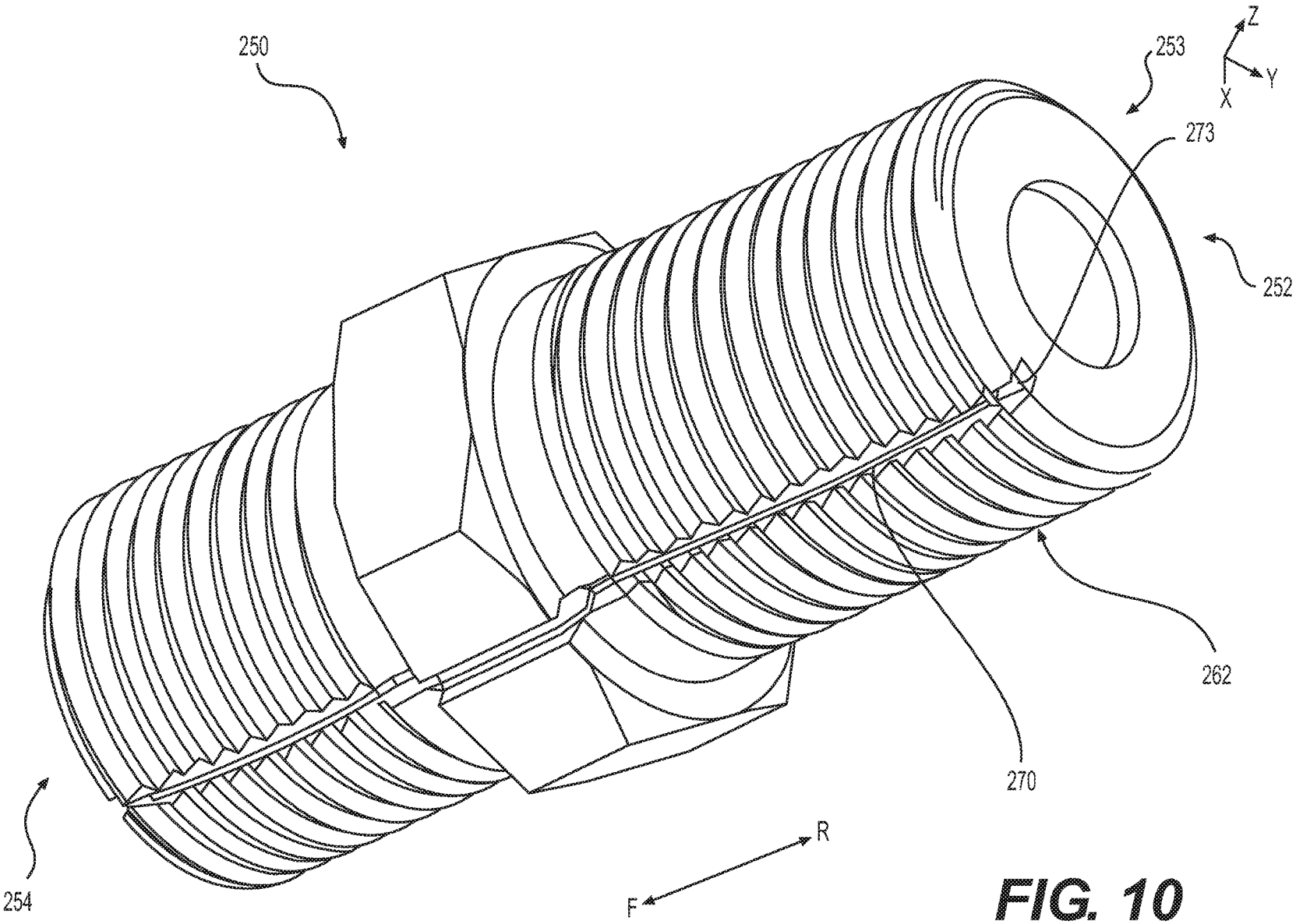
FIG. 10 is a perspective view of a portion of an exemplary apparatus for improving electrical continuity between a cable connector and a barrel connector.
Figure 11:
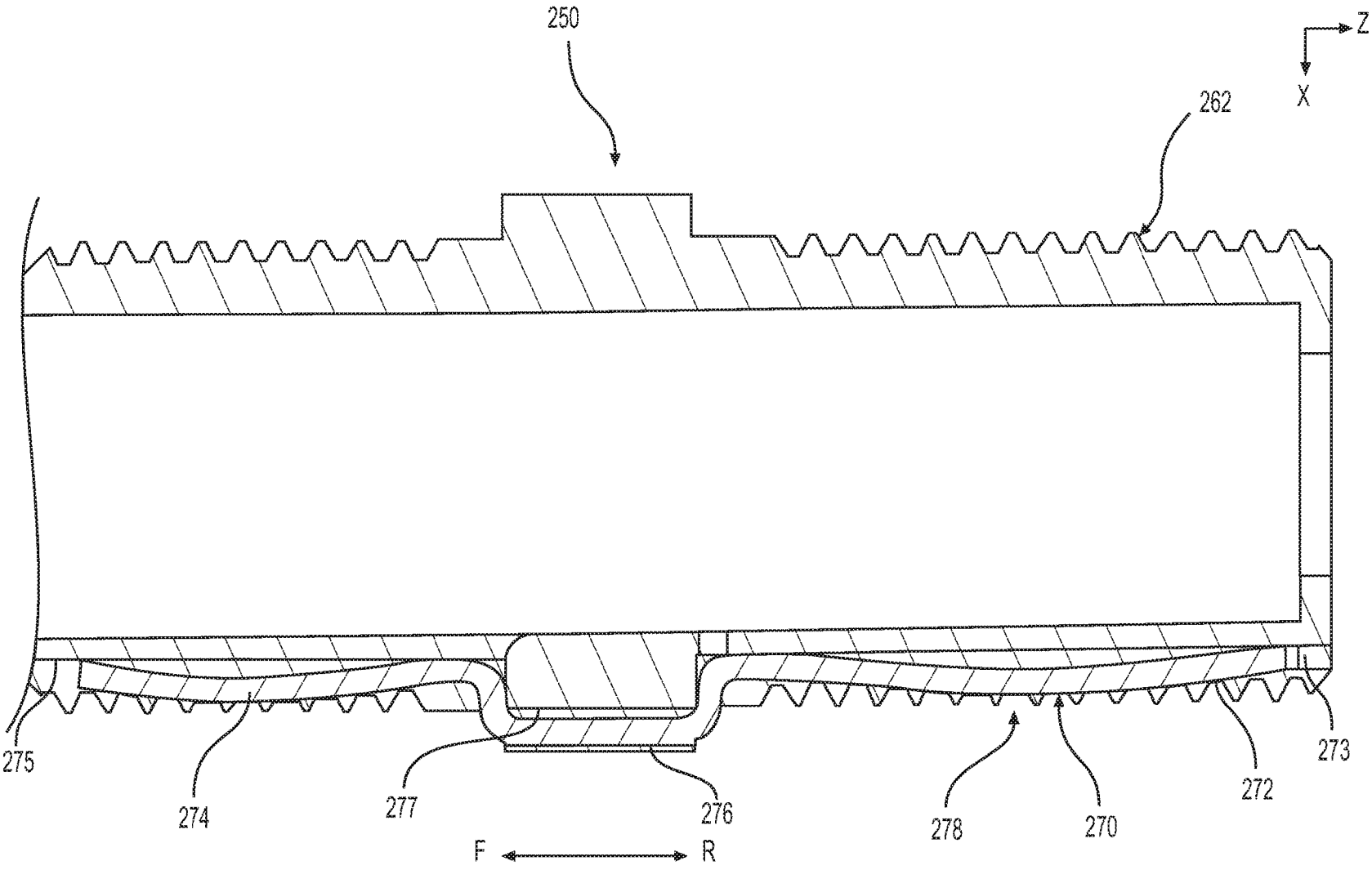
FIG. 11 is a side cross-sectional view of the portion of the apparatus of FIG. 10.
Figure 12:
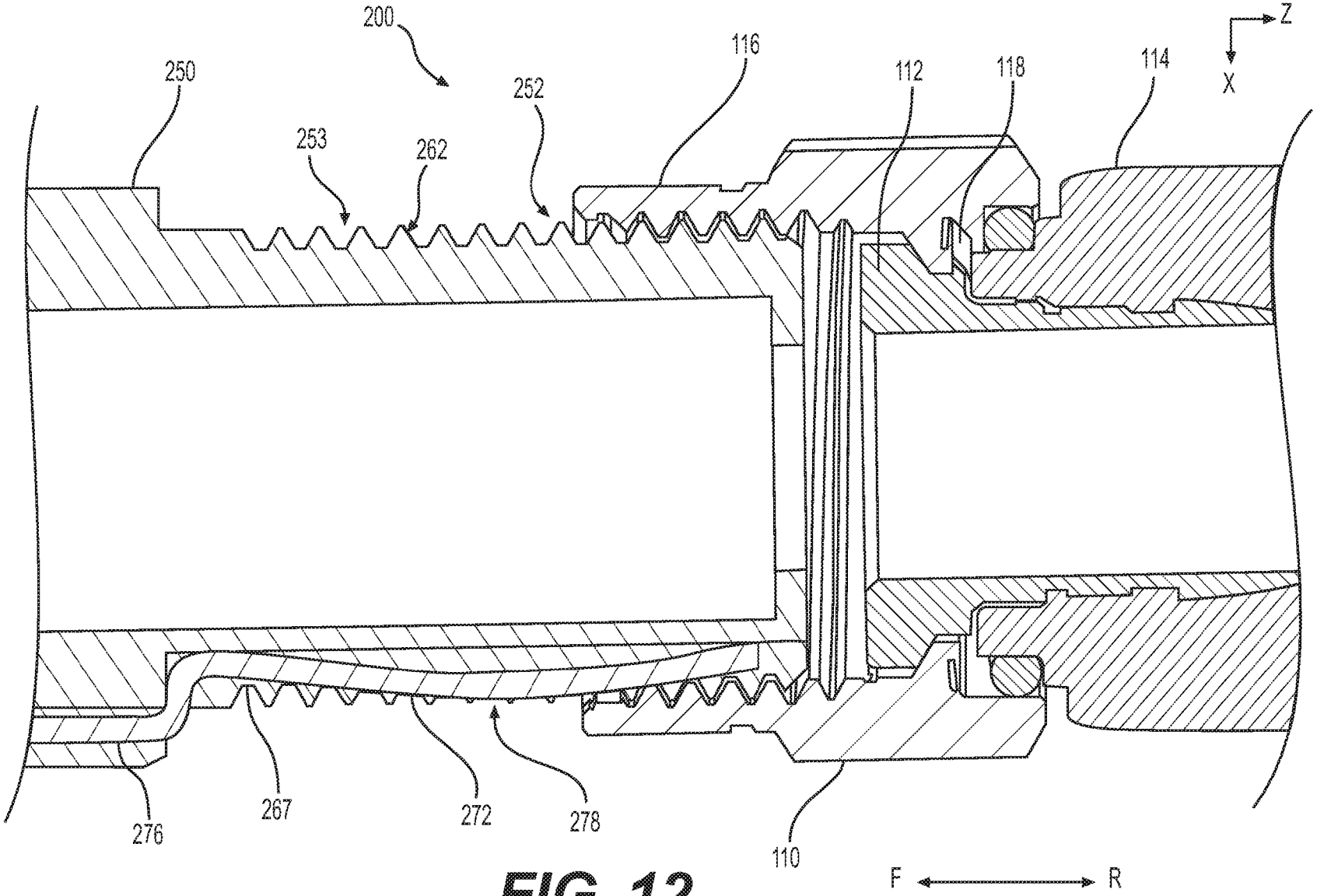
FIG. 12 is a side cross-sectional view of the portion of the apparatus of FIG. 10 connected with a cable connector.

Referring to FIGS. 10-12, another embodiment of an apparatus 200 for improving electrical continuity between the cable connector 110 and a barrel connector 250 is disclosed. Particularly, the apparatus 200 is configured to improve electrical continuity between the threaded coupler 116 of the cable connector 110 and one of the ends 252, 254 of the barrel connector 250 (female end 252 illustrated in FIG. 12). The apparatus 200 includes the cable connector 110, the barrel connector 250, and a resilient member 270, which may be a type of leaf spring having first and second resilient fingers 272, 274 connected together by a bridge portion 276.

As shown in FIGS. 10-12, the barrel connector 250 includes axially-extending channels, or grooves, 273, 275 cut into the outer surfaces 262, 264 of the first and second ends 252, 254 of the barrel connector 250 and an axially-extending channel, or groove, 277 cut into an outer surface 266 of the hex head 256. The resilient member 270 and the channels 273, 275, 277 are cooperatively sized and configured such that the bridge portion 276 is received by channel 277, while the first and second resilient fingers 272, 274 are respectively received by channels 273, 275. In some aspects, the channels 273, 275, 277 may be referred to as single channel. Referring to FIG. 12 (illustrated female end 252), in an uncompressed (i.e., rest) configuration of the resilient member 270, a middle portion 278 of the first resilient finger 272 is bowed outwardly at least beyond the one or more of the valleys 267 defined by the threaded outer surface 262 of female end 252 of the barrel connector 250. As would be understood by persons skilled in the art, as the first resilient finger 272 is compressed inwardly in the radial direction, the middle portion 278 is disposed more proximate to the valleys 267.

As shown in FIG. 12, when the threaded coupler 116 is coupled with the threaded outer surface 262 of the female end 252, relative rotation of the coupler 116 relative to the female end 252, for example, in a clockwise direction, brings the forward end face 136 of the threaded coupler 116 into contact with the middle portion 278 of the first resilient finger 272. Continued relative rotation of the coupler 116 relative to the female end 252 causes the threads of the threaded coupler 116 to compress the middle portion 278 of the first resilient finger 272 radially inward toward the valleys 267. Meanwhile, the first resilient finger 272 provides a reactive force in the radially-outward direction against the threads of the threaded coupler 116. As a result, the first resilient finger 272 moves the threaded coupler 116 relative to the barrel connector 250 in a transverse direction perpendicular to the axial direction. Thus, at a side 253 of the female end 252 opposite to the channel 273, the threads of the coupler 116 and the threads of the outer surface 262 of the female end 252 are urged into close contact such that electrical continuity between cable connector 110 and the barrel connector 250 is maintained even when the threaded coupler 116 is loosely tightened (i.e., partially tightened, but not fully tightened) to the barrel connector 250.

Figure 13:
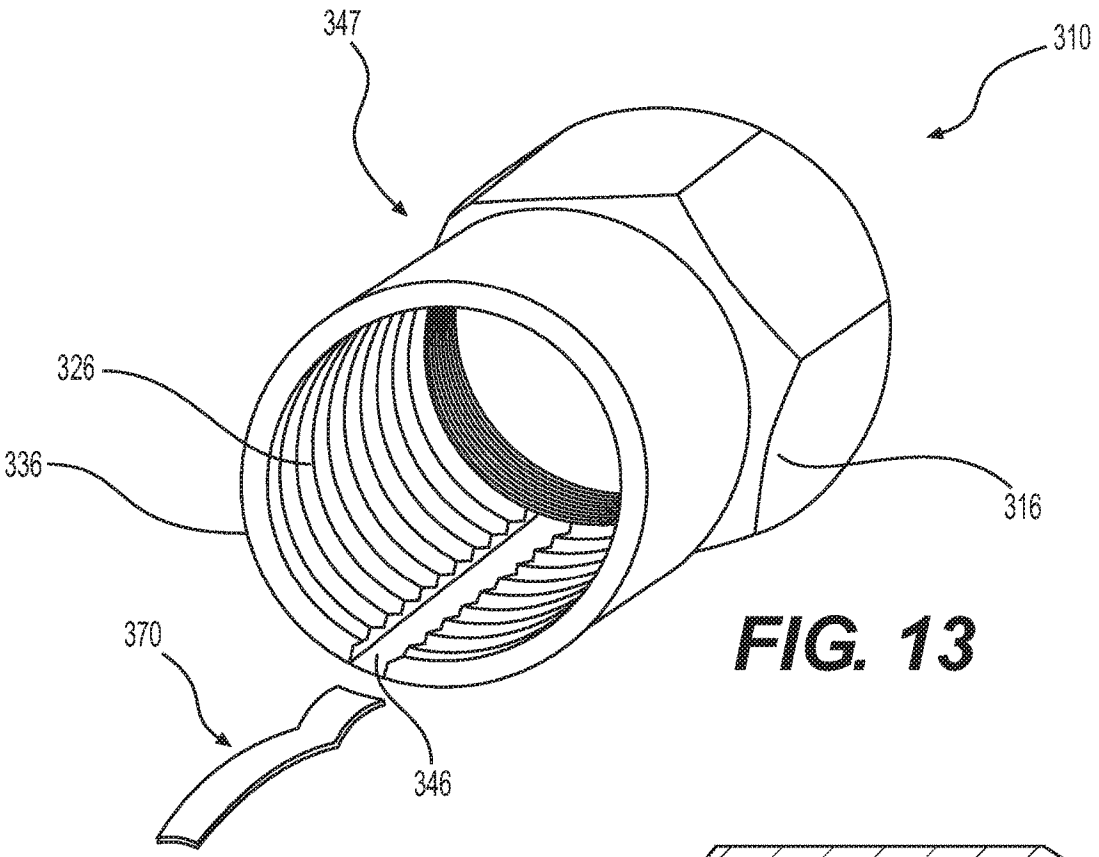
FIG. 13 is a perspective view of a portion of an exemplary apparatus for improving electrical continuity between a cable connector and a barrel connector.
Figure 14:
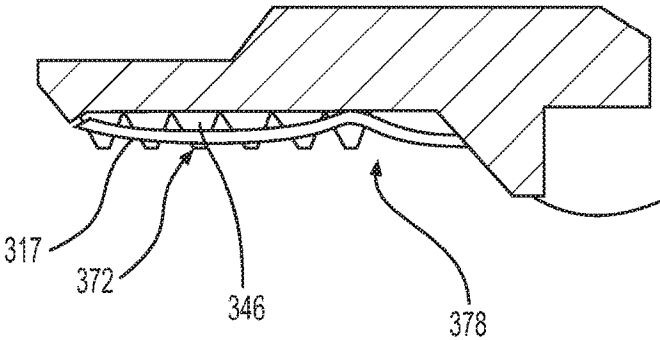
FIG. 14 is a side cross-sectional view of the portion of the portion of the apparatus of FIG. 13.
Figure 15:
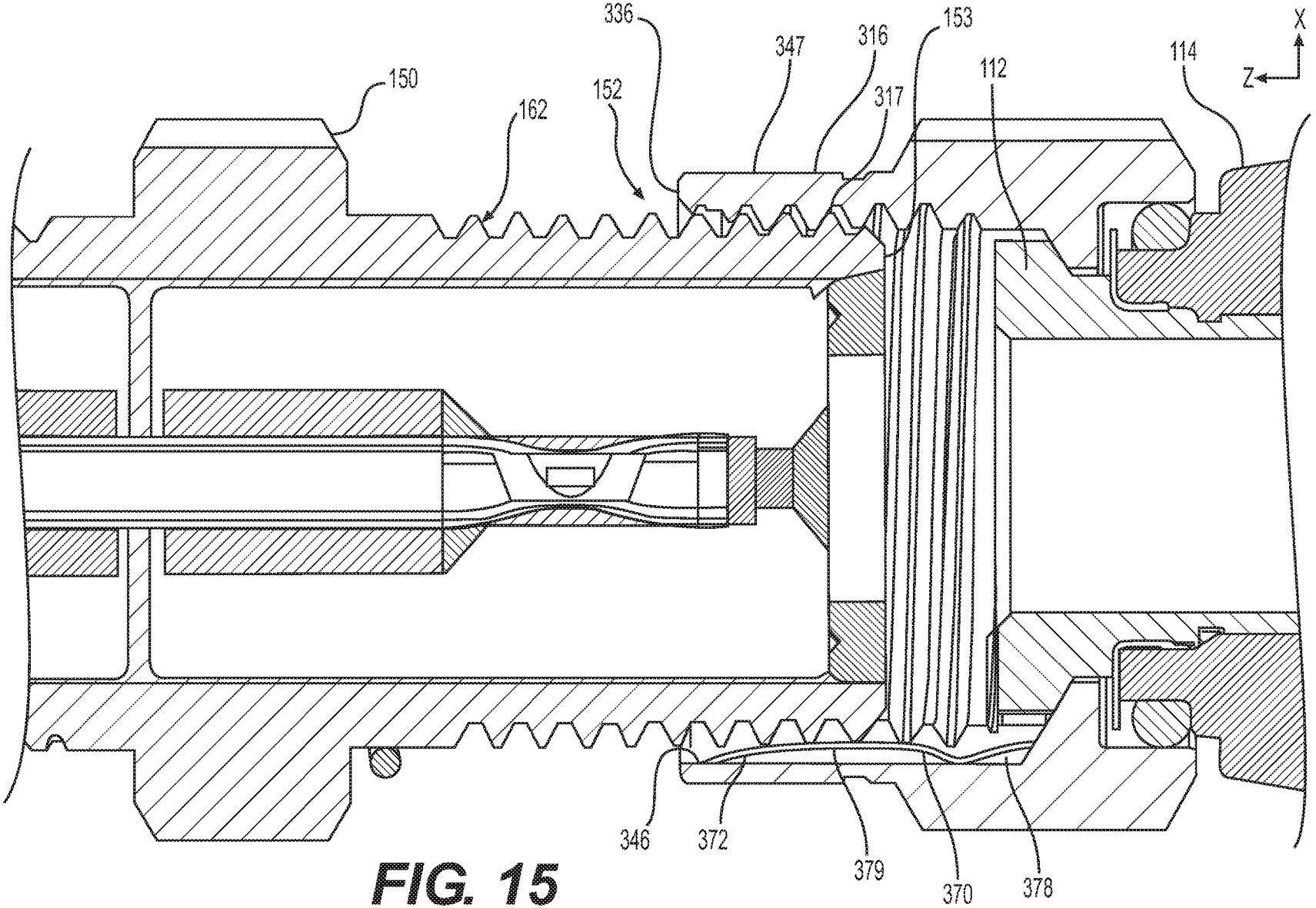
FIG. 15 is a side cross-sectional view of the portion of the apparatus of FIG. 13 connected with a barrel connector.
Figure 16:
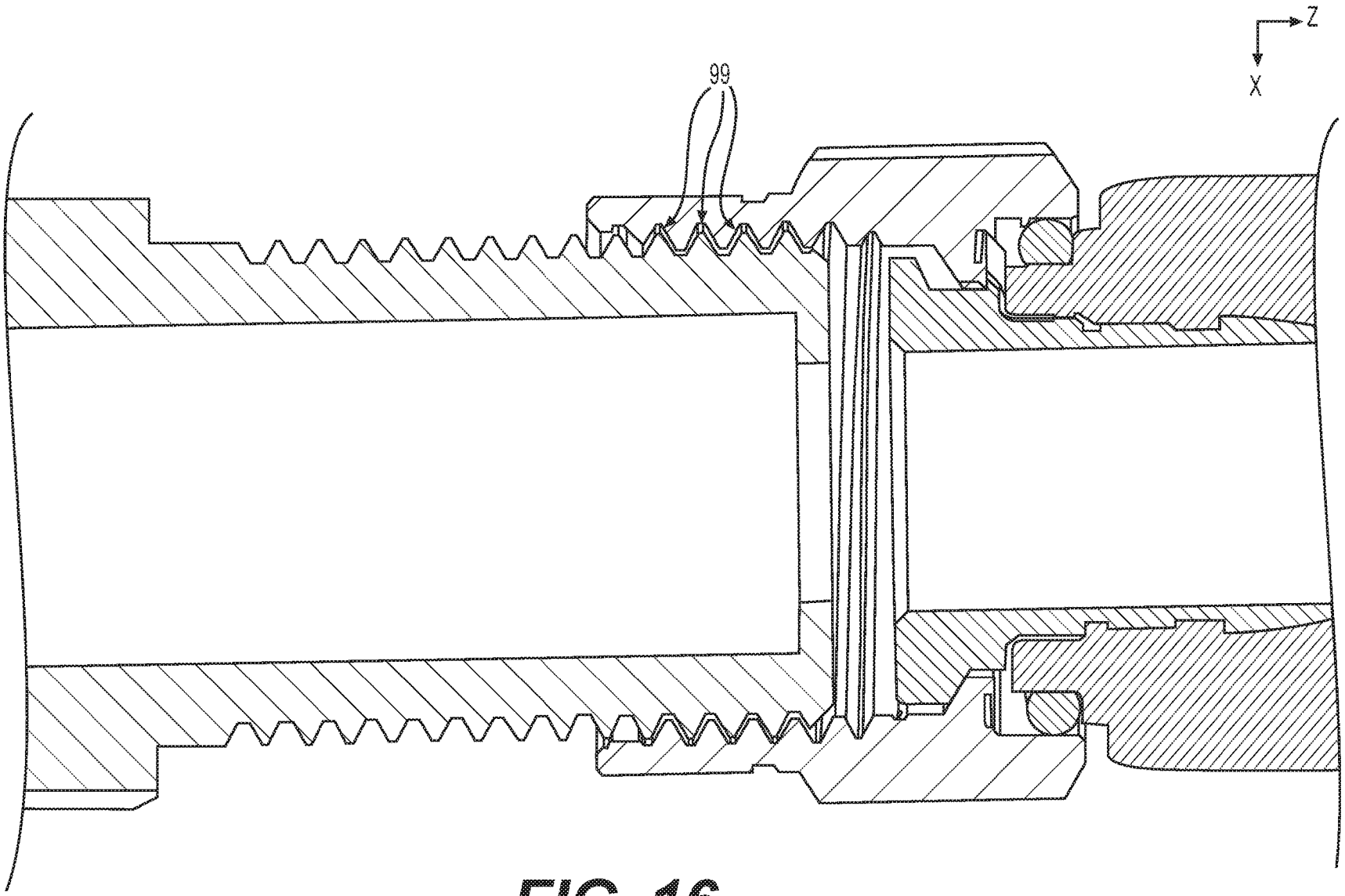
FIG. 16 is side cross-sectional view of a conventional cable connector connected with a barrel connector.

Referring now to FIGS. 13-15, another embodiment of an apparatus 300 for improving electrical continuity between the cable connector 310 and a barrel connector 150 is disclosed. Particularly, the apparatus 300 is configured to improve electrical continuity between the threaded coupler 316 of the cable connector 310 and one of the female ends 152, 154 of the barrel connector 150 (female end 152 illustrated in FIG. 15). The apparatus 300 includes the cable connector 310, the barrel connector 150, and a resilient member 370, which may be a type of leaf spring have a thread contact portion 372 and an optional post contact portion 378.

As shown in FIGS. 13-15, the threaded coupler 316 includes an axially-extending channel, or groove, 346 cut into the inner threaded surface 326 of the coupler 316. The channel 346 may extend from the forward end face 336 of the threaded coupler 316 to an inward flange 348 of the coupler 316 that bearingly engages the outer conductor engager (or post) 112. The resilient member 370 and the channel 346 are cooperatively sized and configured such that the post contact portion 378 is disposed at the rearward end of the channel 346, and the thread contact portion 372 extends forwardly from the post contact portion 378. Referring to FIG. 14, in an uncompressed (i.e., rest) configuration of the resilient member 370, a middle portion 379 of the thread contact portion 372 is bowed radially inward at least beyond one or more of the valleys 317 defined by the threaded inner surface 326 of threaded coupler 316. As would be understood by persons skilled in the art, as the thread contact portion 372 is compressed outwardly in the radial direction, the middle portion 379 is disposed more proximate to the valleys 317.

When the threaded coupler 316 is coupled with the threaded outer surface 162 of the female end 152, relative rotation of the coupler 316 relative to the female end 152, for example, in a clockwise direction, brings an end face 153 of the female end 152 of the barrel connector 150 into contact with the middle portion 379 of the thread contact portion 372 of the resilient member 370. Continued relative rotation of the coupler 316 relative to the female end 152 causes the threads of the female end 152 of the barrel connector 150 to compress the middle portion 379 of the thread contact portion 372 radially outward toward the valleys 317. Meanwhile, the thread contact portion 372 provides a reactive force in the radially-inward direction against the threads of the female end 152 of the barrel connector 150. As a result, the resilient member 370 moves the threaded coupler 316 relative to the barrel connector 150 in a transverse direction perpendicular to the axial direction. Thus, at a side 347 of the coupler 316 opposite to the channel 346, the threads of the coupler 316 and the threads of the outer surface 162 of the female end 152 are urged into close contact such that electrical continuity between cable connector 310 and the barrel connector 150 is maintained even when the threaded coupler 316 is not fully tightened to the barrel connector 150. Moreover, the post contact portion 378 of the resilient member 370 further extends continuity from the threads of the coupler 316 and outer surface 162 to a flange 122 of the outer conductor engager 112.

Additional embodiments include any one of the embodiments described above, where one or more of its components, functionalities or structures is interchanged with, replaced by or augmented by one or more of the components, functionalities or structures of a different embodiment described above.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

What is claimed is:

1. A device for maintaining grounding with a port, comprising:

a resilient portion configured to be arranged on an outermost circumferential surface of a threaded outer surface of an interface port when a connector is assembled so as to exert a radial biasing force between a coupler and the interface port, wherein the radial biasing force maintains a coupler contact portion of a threaded inner surface of the coupler into radial contact with a port contact portion of the threaded outer surface of the interface port so as to biasingly prevent the coupler contact portion and the port contact portion from being radially separated from each other during operation of the connector and biasingly maintain a ground path between the coupler and the threaded outer surface of the interface port during operation of the connector and even when the coupler is loosely tightened to the interface port.

2. The device of claim 1, wherein the resilient portion comprises a resilient member that is a separate and distinct component of the interface port.

3. The device of claim 1, wherein the resilient portion comprises a resilient member that is a separate and distinct component of the coupler.

4. The device of claim 1, wherein the resilient portion is configured to also urge the coupler in an axial direction relative to a longitudinal axis of the interface port.

5. The device of claim 1, wherein the threaded outer surface of the interface port is located at a first end of the interface port, and the interface port includes a second end spaced apart from the first end along a longitudinal axis of the interface port and a flange located between the first end and the second end so as to define a shoulder facing the first end; and wherein the resilient portion is configured to be arranged between the shoulder of the interface port and the coupler so as to urge the coupler away from the shoulder in an axial direction relative to the longitudinal axis of the interface port and urge threads of the threaded inner surface of the coupler into engagement with threads of the threaded outer surface of the interface port to biasingly maintain the ground path between the coupler and the threaded outer surface of the interface port.

6. The device of claim 5, wherein the resilient portion comprises a coil spring that is configured to extend about the threaded outer surface of the first end of the interface port when the connector is assembled.

7. The device of claim 5, wherein the resilient portion is configured such that, as the coupler is rotated relative to the first end of the interface port in a tightening direction, a forward end face of the coupler compresses the resilient portion against a rearward-facing surface of the shoulder and the resilient portion reactively urges the coupler away from the shoulder such that rearward-facing surfaces of the threaded inner surface of the coupler contact forward-facing surfaces of the threaded outer surface of the first end of the interface port.

8. The device of claim 1, wherein the resilient portion is configured to also urge the coupler in a radial direction relative to a longitudinal axis of the interface port.

9. The device of claim 1, wherein the resilient portion is configured to be arranged between the interface port and the coupler in a radial direction relative to a longitudinal axis of the interface port so as to urge the coupler and a first end of the interface port away from one another at a first location about a circumference of the interface port, urge the coupler and the first end of the interface port toward one another at a second location about the circumference of the interface port that is diametrically opposed to the first location, and urge threads of the threaded inner surface of the coupler into engagement with threads of the threaded outer surface of the interface port to biasingly maintain the ground path between the coupler and the threaded outer surface of interface port during operation of the connector.

10. The device of claim 9, wherein the threaded outer surface of the interface port includes a groove extending in the axial direction so as to receive the resilient portion when the connector is assembled.

11. The device of claim 9, wherein the resilient portion is configured to be received in an axially extending groove provided in the threaded inner surface of the coupler.

12. The device of claim 1, wherein the interface port is a barrel connector, and the threaded outer surface of the interface port is a female end.

13. The device of claim 1, further comprising:

a cable connector including the coupler having the threaded inner surface, the coupler being configured to rotatably couple the threaded inner surface with the threaded outer surface of a first end of the interface port, wherein the resilient portion is arranged between the interface port and the coupler.

14. A device for biasingly maintaining a ground path between a coupler and an interface port, comprising:

a resilient portion arranged between a shoulder of an interface port and an end portion of the interface port and on an outer circumferential portion of a threaded outer surface of the interface port so as to exert a biasing force that urges a coupler away from the shoulder in an axial direction relative to a longitudinal axis of the interface port, radially bias a threaded portion of a threaded inner surface of the coupler into engagement with a threaded portion of the threaded outer surface of the interface port, and biasingly maintain a ground path between the coupler and the threaded outer surface of the interface port.

15. The device of claim 14, wherein the end portion of the interface port comprises a first end portion having the threaded outer surface, and the interface port includes a second end portion spaced apart from the first end portion along the longitudinal axis.

16. The device of claim 15, wherein the interface port includes a flange portion that is located between the first end portion and the second end portion and is configured to define a shoulder portion facing the first end portion.

17. The device of claim 14, wherein the coupler is configured to rotatably couple the threaded inner surface of the coupler with the threaded outer surface of the interface port.

18. The device of claim 14, wherein the resilient portion comprises a resilient member that is a separate and distinct component of the interface port.

19. The device of claim 14, wherein the resilient portion comprises a resilient member that is a separate and distinct component of the coupler.

20. The device of claim 14, wherein the resilient portion is configured to biasingly maintain the ground path between the coupler and the threaded outer surface of interface port even when the coupler is loosely tightened to the interface port.

21. The device of claim 14, wherein the resilient portion comprises a coil spring extending about the threaded outer surface of the end portion of the interface port.

22. The device of claim 14, wherein the resilient portion is configured such that, as the coupler is rotated relative to the end portion of the interface port in a tightening direction, a forward end face of the coupler compresses the resilient portion against a rearward-facing surface of a shoulder portion of the interface port and the resilient portion reactively urges the coupler away from the shoulder such that rearward-facing surfaces of the threaded inner surface of the coupler contact forward-facing surfaces of the threaded outer surface of the end portion of the interface port.

23. The device of claim 14, wherein the interface port is a barrel connector, and the end portion of the interface port is a female end.

24. The device of claim 14, further comprising:

a cable connector including the coupler having the threaded inner surface, the coupler being configured to rotatably couple the threaded inner surface with the threaded outer surface of the end portion of the interface port, wherein the resilient portion is arranged between a shoulder of the interface port and the coupler.

25. A device for biasingly maintaining a ground path between a coupler and an interface port, comprising:

a resilient portion configured to be arranged in a radial direction relative to a longitudinal axis of the interface port when a connector is assembled and engaged the interface port so as to exert a biasing force that is configured to urge the coupler and an end portion of the interface port away from one another at a first location about a circumference of the interface port, urge the coupler and the end portion of the interface port toward one another at a second location about the circumference of the interface port that is diametrically opposed to the first location, and urge threads of a threaded inner surface of the coupler into engagement with threads of a threaded outer surface of the interface port to biasingly maintain a ground path between the coupler and the threaded outer surface of interface port during operation of the connector.

26. The device of claim 25, wherein the end portion of the interface port comprises the threaded outer surface.

27. The device of claim 25, wherein the coupler is configured to rotatably couple the threaded inner surface with the threaded outer surface of the interface port.

28. The device of claim 25, wherein the resilient portion comprises a resilient member that is a separate and distinct component of the interface port.

29. The device of claim 25, wherein the resilient portion comprises a resilient member that is a separate and distinct component of the coupler.

30. The device of claim 25, wherein the resilient portion is configured to biasingly maintain the ground path between the coupler and the threaded outer surface of interface port even when the coupler is loosely tightened to the interface port.

31. The device of claim 25, wherein the threaded outer surface of the end portion of the interface port includes a groove extending in an axial direction so as to receive the resilient portion.

32. The device of claim 25, wherein the resilient portion is configured to be received in an axially extending groove provided in the threaded inner surface of the coupler.

33. The device of claim 25, wherein the interface port is a barrel connector, and the end portion of the interface port is a female end.

34. The device of claim 25, further comprising:

a cable connector including the coupler having the threaded inner surface, the coupler being configured to rotatably couple the threaded inner surface with the threaded outer surface of the end portion of the interface port, wherein the resilient portion is arranged between the interface port and the cable connector in the radial direction relative to the longitudinal axis of the interface port.

35. The device of claim 25, wherein the resilient portion is arranged on an outer circumferential surface at the threaded outer surface of the interface port.

36. A device for biasingly maintaining a ground path between a coupler and an interface port, comprising:

a resilient portion arranged adjacent to the interface port, the resilient portion being configured to apply a radial force that urges the coupler and an end portion of the interface port toward one another, urge threads of a threaded inner surface of the coupler into engagement with threads of a threaded outer surface of the interface port, and biasingly prevent the threads of the threaded inner surface of the coupler and the threads of the threaded outer surface of the interface port from radially separating from one another so as to radially and biasingly maintain a ground path between the coupler and the threaded outer surface of interface port.

37. The device of claim 36, wherein the resilient portion comprises a resilient member that is a separate and distinct component of the interface port.

38. The device of claim 36, wherein the resilient portion comprises a resilient member that is a separate and distinct component of the coupler.

39. The device of claim 36, wherein the resilient portion is arranged in a radial direction relative to a longitudinal axis of the interface port, and the resilient portion is configured to urge the coupler and the end portion of the interface port away from one another at a first location about a circumference of the interface port, and urge the coupler and the end portion of the interface port toward one another at a second location about the circumference of the interface port that is diametrically opposed to the first location so as to urge threads of the threaded inner surface of the coupler into engagement with threads of the threaded outer surface of the interface port to biasingly maintain the ground path between the coupler and the threaded outer surface of interface port.

40. The device of claim 36, wherein the resilient portion is configured to biasingly maintain the ground path between the coupler and the threaded outer surface of interface port even when the coupler is loosely tightened to the interface port.

41. The device of claim 36, wherein the threaded outer surface of the end portion of the interface port includes a groove extending in the axial direction so as to receive the resilient portion.

42. The device of claim 36, wherein the resilient portion is configured such that the resilient portion can be received in an axially extending groove provided in the threaded inner surface of the coupler.

43. The device of claim 36, wherein the interface port is a barrel connector, and the end portion of the interface port is a female end.

44. The device of claim 36, further comprising:

a cable connector including the coupler having the threaded inner surface, the coupler being configured to rotatably couple the threaded inner surface with the threaded outer surface of the end portion of the interface port, wherein the resilient portion is arranged between the interface port and the cable connector in the radial direction relative to a longitudinal axis of the interface port.

45. The device of claim 36, wherein the resilient portion is arranged on an outer circumferential surface at the threaded outer surface of the interface port.

* * * * *